United States Patent [19]

Crane

[11] 4,445,839

[45] May 1, 1984

[54] RECIPROCATING TAMPER FOR A CONCRETE MOLD PRESS

[75] Inventor: Julius Crane, Ft. Lauderdale, Fla.

[73] Assignee: Metalfab, Inc., Beaver Dam, Wis.

[21] Appl. No.: 419,079

[22] Filed: Sep. 16, 1982

[51] Int. Cl.[3] ..... B28B 21/12; B28B 21/14

[52] U.S. Cl. ..... 425/421; 425/424; 425/425; 425/431; 425/432

[58] Field of Search ..... 425/219, 260, 130, 421, 425/424, 425, 429, 456, 432, 431; 264/69, 72

[56] References Cited

U.S. PATENT DOCUMENTS

| | | | |
|---|---|---|---|
| 1,937,028 | 11/1933 | Lux et al. | 425/421 |
| 1,987,721 | 1/1935 | Straub | 264/71 |
| 2,314,577 | 3/1943 | Dunn | 425/219 |
| 2,648,115 | 8/1953 | Maramente | 425/130 |
| 2,909,826 | 10/1959 | McElroy | 425/456 |
| 2,957,221 | 10/1960 | Zmania | 425/145 |
| 2,957,222 | 10/1960 | Zmania | 425/219 |
| 3,013,321 | 12/1961 | McElroy | 425/421 |
| 3,184,818 | 5/1965 | Crile | 425/135 |
| 3,225,411 | 12/1965 | Rybicki | 425/424 |
| 3,296,675 | 1/1967 | Filangeri | 425/130 |
| 3,382,304 | 5/1968 | Nagy | 425/130 |
| 3,781,156 | 12/1973 | Moore | 425/424 |
| 3,811,808 | 5/1974 | Platt | 425/167 |
| 3,955,907 | 5/1976 | Yamasita | 425/130 |
| 4,063,866 | 12/1977 | Lurbiecki | 425/424 |
| 4,111,627 | 9/1978 | Kitahara | 425/421 |
| 4,201,530 | 5/1980 | Vogt | 425/260 |
| 4,265,609 | 5/1981 | Kitahara | 425/260 |

*Primary Examiner*—Willard E. Hoag

*Attorney, Agent, or Firm*—Andrus, Sceales, Starke & Sawall

[57] ABSTRACT

A concrete mold press for a concrete molding machine includes a reciprocating tamper operatively movable to an operative position in pressing contact with the concrete in a mold. The tamper includes a tamping plate mounted to vertically oscillate in response to the press head vibrations to repeatedly strike the press head to provide a tamping force which compacts the concrete in the mold.

16 Claims, 15 Drawing Figures

RECIPROCATING TAMPER FOR A CONCRETE MOLD PRESS

CROSS REFERENCE TO RELATED APPLICATION

A portion of the disclosure in this application is also disclosed and/or claimed in the following concurrently filed application:

Ser. No. 419,078, filed Sept. 16, 1982 in the name of Julius Crane and entitled "Feed Drawer Concrete Distribution Control".

BACKGROUND OF THE INVENTION

The present invention relates to concrete molding machines, and more particularly to a press for a concrete molding machine employing a reciprocating tamper.

Concrete molding machines are well known in the art, and generally include a feed drawer to receive a concrete mix from a feed hopper and deliver the mix to a preformed mold. The raw or unhardened concrete contained in the feed drawer is generally deposited by gravity into the mold while the mold is being vibrated.

In concrete molding machines such as those utilized for molding concrete blocks, it is desirable to eject or remove the molded concrete block from the mold as soon as possible, and to provide a block having uniform density and strength. In order to accomplish this, it is generally necessary to press or compact the raw concrete mix in the mold while the mold is vibrated.

Various arrangements are known for pressing or compacting the concrete while in the mold. One such arrangement is shown in Moore, U.S. Pat. No. 3,781,156 which discloses a concrete molding machine having a reciprocating tamper operated in response to air pressure applied to the piston of a pneumatic cylinder. Another arrangement is shown in Kitahara, U.S. Pat. No. 4,111,627 which discloses a concrete molding machine having a plunger mounted on a supporting frame. The plunger is pressed against the concrete in a mold by means of oil pressure applied to the pistons of a pair of hydraulic cylinders, and by the resilience of a pair of springs encircling the outer ends of the pistons. Another arrangement is shown in Rybicki, U.S. Pat. No. 3,225,411 which discloses an apparatus for compressing finely divided clay material into a brick. The Rybicki apparatus includes a pair of pneumatically operated spike hammers which repeatedly strike a pair of die plates to compress the clay material. Further, Kitahara, U.S. Pat. No. 4,265,609 discloses a concrete molding machine having a press plate which applies pressure against the concrete in a mold. The press plate is actuated by means of a piston rod of a hydraulic cylinder.

SUMMARY OF THE INVENTION

The invention relates to an improved means for compacting the concrete mix in a mold.

A concrete mold press for a concrete molding machine includes means for compacting the concrete in a mold. The compacting means includes a vibrating press head and a reciprocating tamper mounted to vertically oscillate to repeatedly strike the press head in response to the press head vibrations. The compacting means compacts the concrete in the mold to provide a concrete product having uniform density and strength which may easily be ejected from the mold.

The concrete mold press includes a main frame and a carriage slidably mounted for vertical movement on the frame above the mold. The press head is carried by the carriage and includes a compacting plate member disposed beneath the carriage and spaced therefrom. A press plate member is carried by and disposed beneath the compacting plate member and spaced therefrom. The press head is movable by the carriage between an operative position wherein the press plate member is in pressing contact with the surface of the concrete in the mold and an inoperative position wherein the press plate member is spaced from the concrete surface. The compacting plate member is vibrated to provide a compacting force which is transferred through the press plate member to the concrete surface when the press head is in its operative position.

The tamper includes a tamping plate member reciprocally mounted on the carriage to vertically oscillate in response to the press head vibrations to repeatedly strike the compacting plate to provide a tamping force which compacts the concrete in the mold. This reciprocal mounting connection is provided by mounting means which permits relative vertical oscillatory movement between the tamping plate member and the compacting plate member. The mounting means includes at least one spring loaded piston and connecting rod. The vibration-producing means is preferably mounted on the tamping plate member and provides the vibratory motion for the press head.

The tamping plate preferably is received within a recess formed in the compacting plate member, and includes at least one opening formed therethrough for receiving a guide pin projecting upwardly from the compacting plate member. The guide pin guides the tamping plate member during its oscillatory motion to ensure vertical movement between the tamping plate and compacting plate members.

The tamper may also include a pair of reciprocally mounted tamping plate members located side-by-side so that each may repeatedly strike the compacting plate member to provide the desired tamping force. In this arrangement, a pair of vibration-producing means is employed with one mounted on each of the tamping plate members.

Other objects and advantages will appear during the course of the following description.

BRIEF DESCRIPTION OF THE DRAWINGS

The drawings illustrate the best mode presently contemplated of carrying out the invention.

In the drawings.

DESCRIPTION OF THE PREFERRED EMBODIMENT

Figure 1:
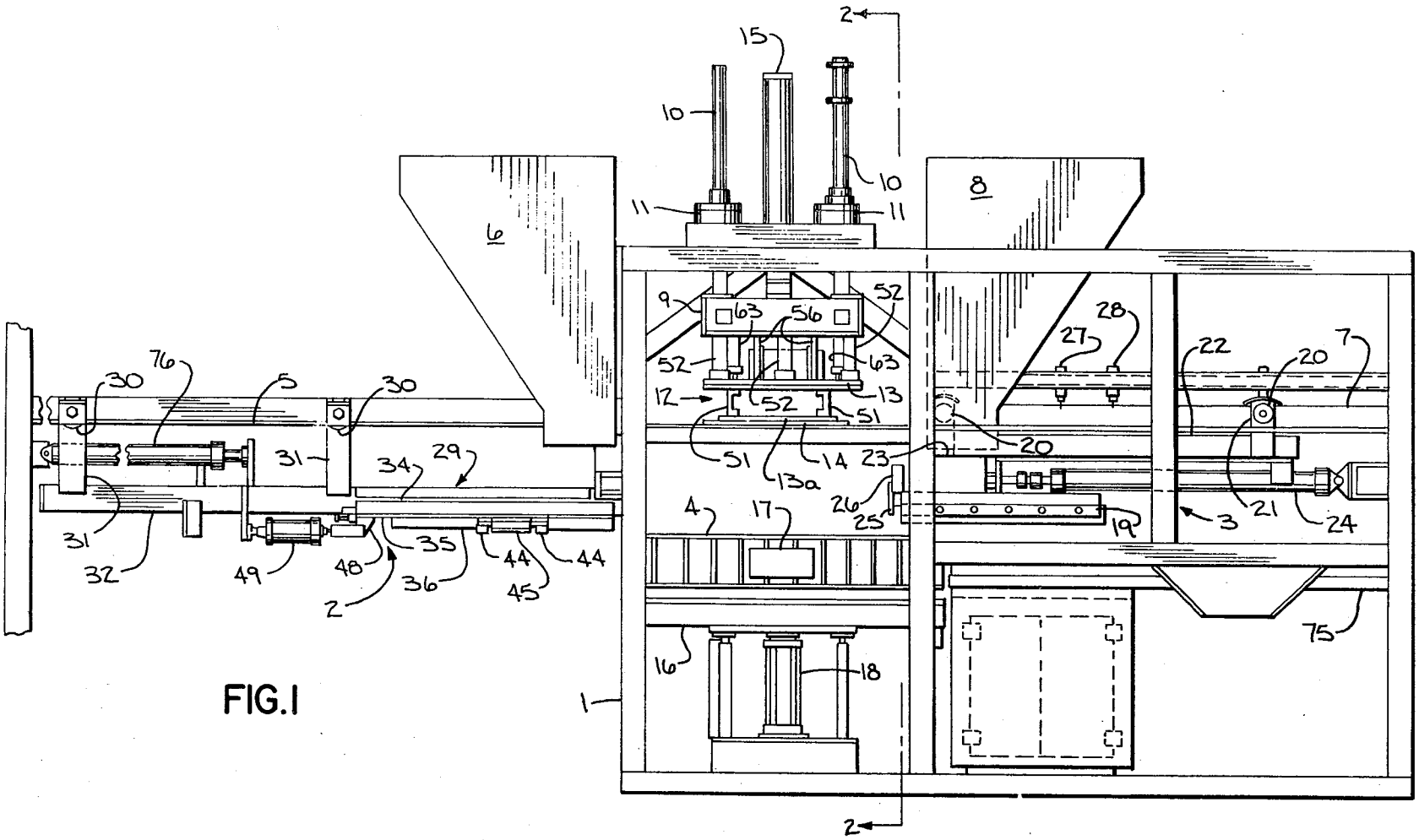
FIG. 1 is a front view in elevation of a concrete molding machine embodying the principles of the present invention.
Figure 2:
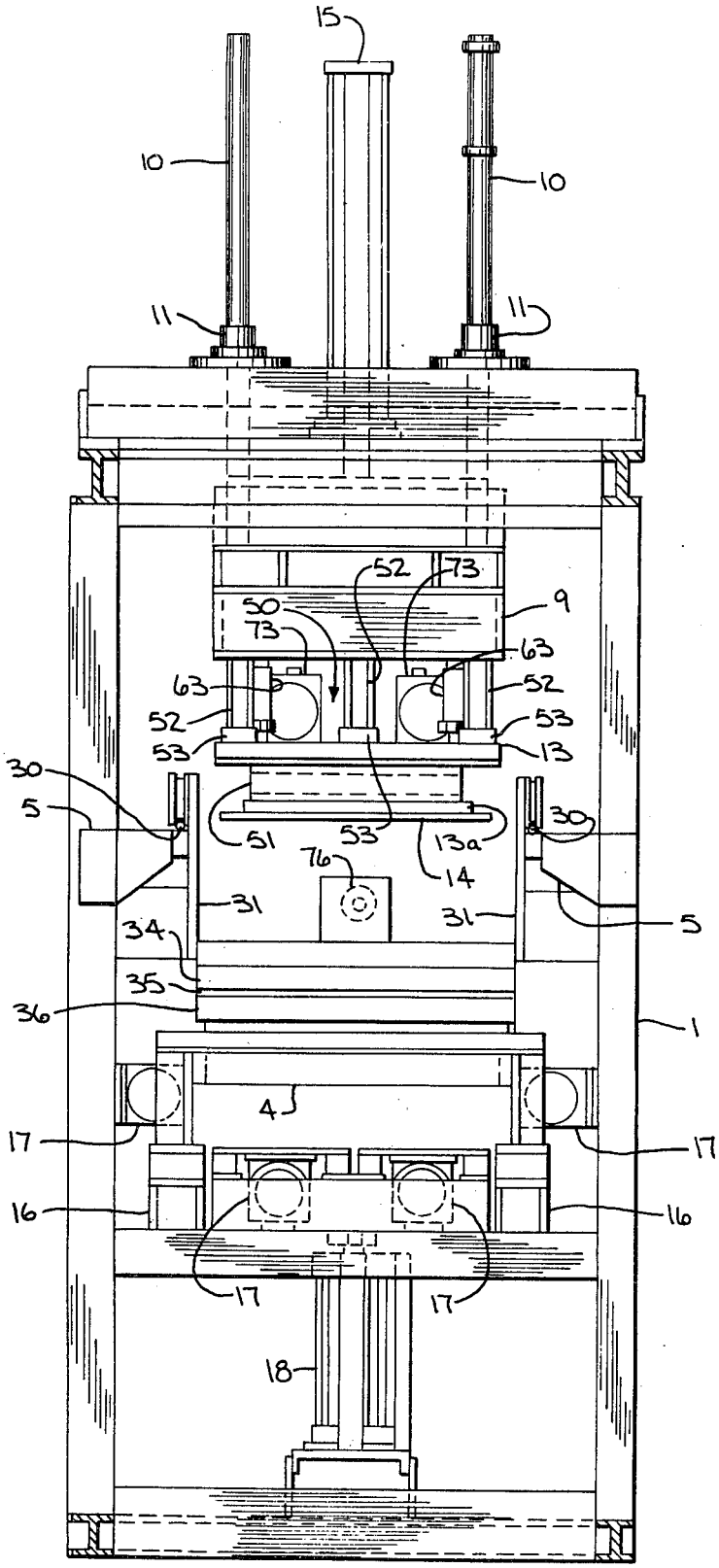
FIG. 2 is a side view in elevation of the concrete molding machine taken along the plane of line 2—2 in FIG. 1.

Referring now to the drawings, FIGS. 1 and 2 show a concrete molding machine for molding concrete products such as concrete blocks. The concrete molding machine shown is of the type which permits sequential depositing of a face layer and a back layer consisting of different types of unhardened or raw concrete within a mold to thereby form a block with a face layer having a different physical appearance from the back layer. For this purpose the concrete molding machine includes a main frame 1 on which is mounted a first concrete feed drawer assembly 2 on the left side of the machine as shown in FIG. 1, and a second concrete feed drawer assembly 3 on the right side of the machine. Both assemblies 2 and 3 are sequentially driven in a horizontal manner from a loading position to a dispensing position which is located above a mold 4 positioned in the center of the machine. Thus for example, feed drawer assembly 2 could be initially operated to deposit a first layer of wet and coarse aggregate concrete including stones of a relatively large size upon the bottom of mold 4 to form the face layer of the block. The second feed drawer assembly 3 could then be operated to provide a second layer of concrete of a drier and finer consistency wherein particles of stone therein are of a relatively smaller size than those in the first layer to form the back layer of the block.

With such contemplated operation, the concrete molding machine includes a pair of rails 5 (only one of which is shown in FIG. 1) extending from the main frame 1 which support the feed drawer assembly 2 for horizontal movement, and a hopper 6 for storing and feeding the wet and coarse aggregate concrete to assembly 2. A second pair of rails 7 are also connected to main frame 1 which support the feed drawer assembly 3 for horizontal movement. A hopper 8 stores and feeds the finer and drier concrete to assembly 3. The machine also includes a press assembly carried by the main frame 1 which vertically moves between an upper inoperative position, which is shown in FIG. 1, and a lower operative position for compressing and compacting the concrete contained within mold 4. The press includes a carriage 9 having a plurality of upright guide rods 10 which extend through a plurality of guide supports 11 mounted on main frame 1. A press head 12 is mounted on carriage 9 and disposed beneath the carriage 9 and spaced therefrom. Press head 12 includes a compacting plate member 13 which, in turn, is attached to a press plate member 14 carried beneath member 13. The press plate member 14 may be a single member or multiple spaced members and is receivable in mold 4 to engage the surface of the concrete contained therein, as will hereinafter be described. The press head 12 and carriage 9 are both movable between the inoperative and operative positions by means of fluid operable cylinder 15, i.e. pneumatic or hydraulic, mounted on main frame 1 having its rod end connected to the top of carriage 9 and extending in an upright manner therefrom.

As seen in FIG. 2, mold 4 is mounted on main frame 1 by means of support members 16, and is fixed in place. Mold 4 is generally box-like in construction without a top or bottom, and it is readily obvious to those skilled in the art that molds of various dimensions may readily be utilized depending on the desired size concrete block to be manufactured. A plurality of vibrators 17 are connected to mold 4 to vibrate mold 4 uniformly in all directions, that is, up and down and left and right, as seen in FIG. 2, during the molding process. A fluid operated cylinder 18, i.e. pneumatic or hydraulic, is located beneath mold 4 and is positioned in an upright manner so that its rod end will move upwardly and downwardly in a vertical manner. The purpose of cylinder 18 will hereinafter be described.

Feed drawer assembly 3 includes a feed drawer 19 which is suspended from the rails or track 7 by means of wheels 20 connected through brackets 21 to a pair of horizontally extending supports 22. Each support 22 is in turn connected through a vertically extending support plate 23 to opposite sides of feed drawer 19. Feed drawer 19 is horizontally reciprocally driven by means of a fluid operated cylinder 24, i.e. pneumatic or hydraulic, between a loading position beneath concrete hopper 8 and an unloading or dispensing position located above concrete mold 4. In its dispensing position, feed drawer 19 permits the unhardened concrete to be discharged by gravity into mold 4 to form the back layer of a concrete block.

A vertically movable gate or doctor blade 25 extends across the front of drawer 19 and may be vertically moved by means of a pair of fluid operated cylinders 26 (only one of which is shown in FIG. 1). The gate or blade 25 provides a means for controlling the density of the concrete within mold 4 in the following manner. Drawer 19 is filled with unhardened concrete as it passes beneath hopper 8, and as drawer 19 moves in a horizontal direction over mold 4, the unhardened concrete is permitted to drop by gravity into the cavity of mold 4. After the concrete from the feed drawer 19 has been deposited within mold 4, the cylinder 24 moves drawer 19 to the right as shown in FIG. 1 back to its initial loading position. As the drawer 19 returns to its initial loading position, the gate or blade 25 provides a leveling action across the top of mold 4 so that excess unhardened concrete may be retained within drawer 19. In order to compensate for density differences of unhardened concrete within mold 4, engagement of brackets 21 for drawer 19 with a control switch 27, i.e. electrical or fluid operated, actuates cylinders 26 to raise blade 25 upwardly to deposit a first predetermined volume of excess unhardened concrete at a first predetermined location in mold 4. When bracket 21 encounters any one of a number of similar control switches 28, blade 25 is again elevated to deposit a second predetermined volume of excess unhardened concrete at a second predetermined location in mold 4. This selective depositing of predetermined volumes of unhardened concrete in mold 4 compensates for variances in the density of the concrete within mold 4 which might otherwise occur.

Figure 3:
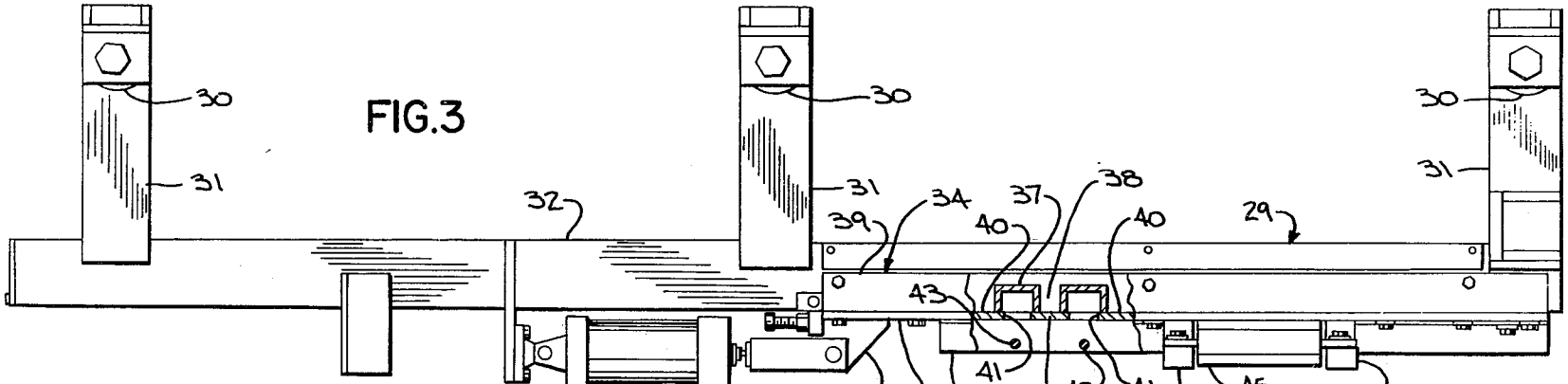
FIG. 3 is a side view in elevation with parts broken away of a concrete feed drawer assembly for the machine of FIG. 1.
Figure 4:
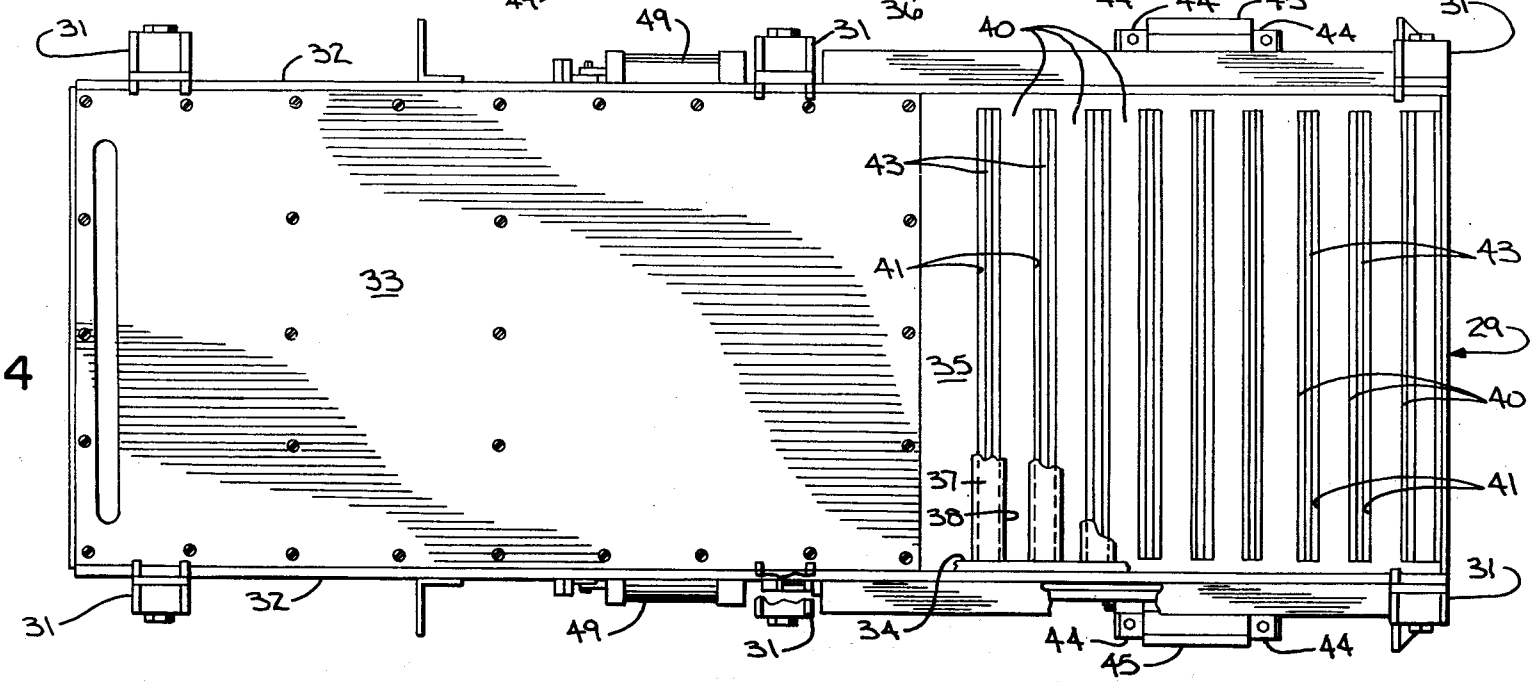
FIG. 4 is a top plan view with parts broken away of the feed drawer assembly shown in FIG. 3.

Referring now to FIGS. 3 and 4, feed drawer assembly 2 for delivering wet and coarse aggregate concrete to mold 4 includes a feed drawer 29 suspended on the rails or track 5 by means of a set of wheels 30. Each wheel 30 is mounted on a bracket 31 which is connected at its lower end to a horizontally extending support member 32 which together form the sides of drawer assembly 2. The entire assembly 2 as well as feed drawer 29 is horizontally driven by means of a fluid cylinder 76, i.e. pneumatic or hydraulic, between a loading position beneath concrete hopper 6, as shown in FIG. 1, and an unloading or dispensing position which is located above concrete mold 4. In its dispensing position feed drawer 29 discharges the unhardened concrete by means of gravity into mold 4 to form the face layer of a concrete block.

Figure 5:
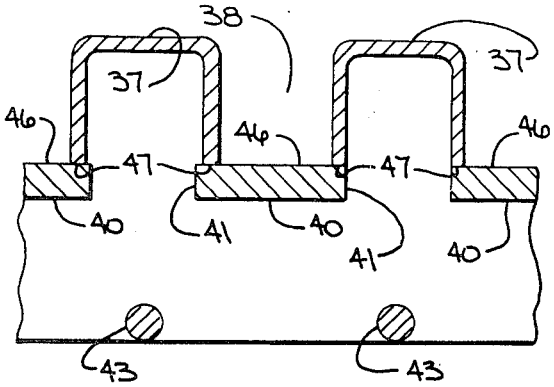
FIG. 5 is an enlarged fragmentary side view showing the feed drawer in its closed position.

As shown best in FIG. 4, the assembly 2 includes the feed drawer 29, and a flat plate 33 both extending between the support members 32. Feed drawer 29 includes a series of horizontally disposed and vertically stacked members which provide for uniform distribution of concrete flowing from drawer 29 into mold 4. Feed drawer 29 includes a base plate member 34, a gate member 35 disposed beneath member 34, and a grill member 36 supported beneath gate member 35. As seen best in FIGS. 3 and 7, base plate member 34 is bolted to support members 32 so as to remain in a fixed position with respect to the members 32. Base plate member 34 includes a plurality of horizontally spaced ribs 37 that define a plurality of spaced, elongated slotted apertures 38. The ribs 37 and apertures 38 extend between a pair of side members 39 which as previously noted are bolted to the support members 32. The ribs 37 are preferably in the form of inverted U-shaped members having rounded edges (as seen best in FIGS. 5 and 6) which permit concrete to readily flow into the apertures 38.

Figure 6:
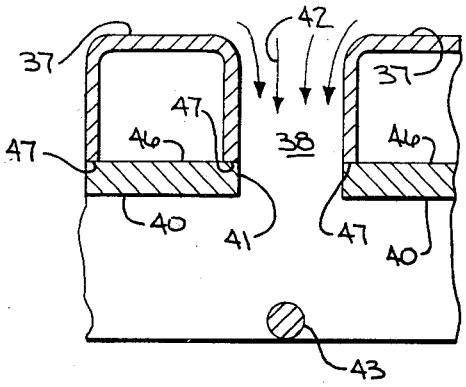
FIG. 6 is an enlarged fragmentary side view similar to FIG. 5 showing the feed drawer in its concrete dispensing position.
Figure 7:
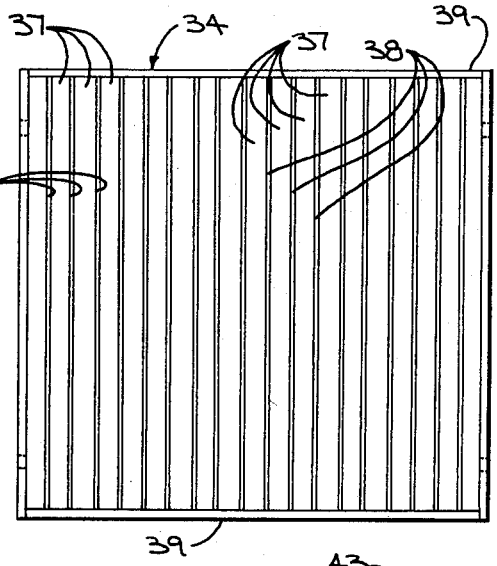
FIG. 7 is a top plan view of the base plate member of the feed drawer shown in FIG. 4.
Figure 8:
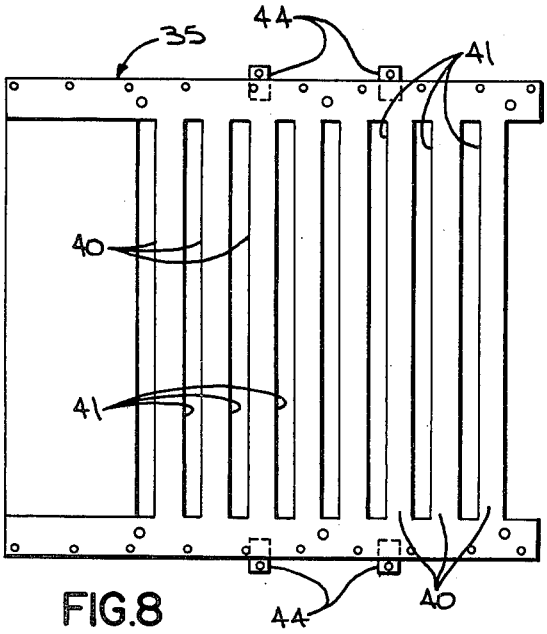
FIG. 8 is a top plan view of the gate member of the feed drawer shown in FIG. 4.

As seen best in FIGS. 3 and 8, gate member 35 is supported beneath base plate 34 for horizontal sliding movement with respect to the fixed ribs 37. Gate member 35 includes a plurality of horizontally spaced cross bar members 40 in the form of slats slidable between a closed position (FIG. 5) and a dispensing position (FIG. 6). In their closed position, slats 40 block the apertures 38 in base plate 34 when feed drawer 29 is being loaded, and in their dispensing position the slotted openings 41 defined by the spaced slats 40 are aligned with the slotted apertures 38 in base plate 34 to permit free flow of concrete therethrough when the feed drawer 29 is being unloaded. As seen best in FIG. 5, slats 40 have a width that is slightly greater than the width of apertures 38 which enables the slats 40 to completely block off apertures 38 to thereby prevent the flow of concrete. As shown in FIG. 6, the width of the openings 41 between slats 40 substantially corresponds to the width of the apertures 38 so that when gate member 35 is in its dispensing position with the apertures 38 and openings 41 in dispensing registry concrete will be permitted to flow by gravity in the direction indicated by the arrows 42. As seen in FIG. 8, the crosswise or longitudinal length of openings 41 substantially correspond to the crosswise length of apertures 38 so as to permit maximum flow of concrete therethrough.

Figure 9:
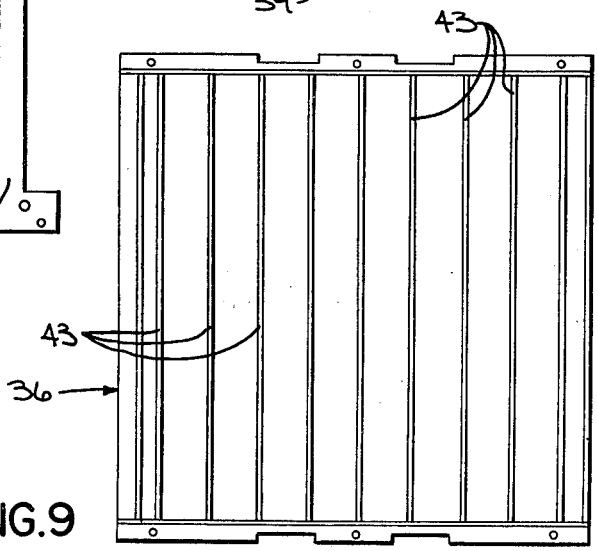
FIG. 9 is a top plan view of the grill member of the feed drawer in FIG. 4.

As seen best in FIGS. 3 and 9, grill member 36 is bolted to the bottom of gate member 35 for coincident movement therewith and includes a plurality of spaced bars 43. Each bar 43 extends parallel to the slats 40 of gate member 35 and is disposed directly beneath and in alignment with the centerline of each slotted opening 41 in gate member 35. The width of the space between adjacent bars 43 of grill member 36 is not greater than the distance between the centerlines of adjacent slotted openings 41 in gate member 35. This width dimension insures that concrete flowing through the apertures 38 of feed drawer 29 when gate member 35 is in its open position engages or strikes the bars 43 to be uniformly distributed into mold 4.

As seen best in FIG. 8, a pair of bracket members 44 project horizontally from opposite sides of gate member 35. Each set of bracket members 44 is utilized to mount a vibrator 45 which provides a vibrating action to the gate member 35 and grill member 36 as the concrete is unloaded. Since gate member 35 slides with respect to base plate 34 the top surface of slats 40 may be considered a bearing surface 46 which is in sliding engagement with a corresponding bearing surface 47 on the underside of ribs 37. Thus, since the surfaces 46 and 47 are in sliding engagement with one another the vibrating action of gate member 35 and grill member 36 will also cause the entire feed drawer 29 to vibrate as the concrete is unloaded. This vibrating action further aids in uniformly distributing the concrete.

As seen in FIG. 3, gate member 35 is connected by means of a bracket 48 to a pair of fluid operated cylinders 49 which are mounted on the support members 32 for coincident movement with assembly 2. Thus, after feed drawer 29 has been loaded with wet and coarse aggregate concrete and is moved to its unloading position over mold 4 the cylinder 49 may be actuated to move gate member 35 and grill member 38 to their dispensing position whereby concrete will be permitted to flow by gravity through the aligned apertures 38 and openings 41 and over the bars 43 while at the same time the drawer 29 is being vibrated by vibrators 45. This operation uniformly distributes the concrete within mold 4 to form the face layer of a concrete block.

After feed drawers 19 and 29 deposit their concrete within mold 4, the concrete mold press is utilized to compress the concrete within mold 4 into a solid mass so that the concrete block may be readily ejected from mold 4. The concrete mold press includes means for compacting the concrete in mold 4. The compacting means includes the vibrating press head 12, the plate member 14, and a reciprocal tamper 50 which is mounted to vertically oscillate to repeatedly strike the press head 12 in response to press head vibrations. The compacting means compacts the concrete in mold 4 to provide a concrete product having uniform density and strength.

As previously noted, carriage 9 is slidably mounted for vertical movement on main frame 1 above mold 4 by means of guide rods 10 and cylinder 15. Press head 12 is carried by the carriage 9 and includes a compacting plate member 13 disposed beneath carriage 9 and spaced therefrom. A concrete-engaging member or press plate member 14 is attached to the press head 12 to be carried by the compacting plate member 13. As seen best in FIG. 1 press plate member 14 is bolted to a lower plate 13*a* which, in turn, is connected to the undersurface of member 13 by means of a pair of spacer members 51 which are welded in place. The press head 12, i.e. plate 13, spacers 51 and plate 13*a*, and the press plate 14 are movable by carriage 9 between an operative position wherein the press plate member 14 is in pressing contact with the surface of the concrete mold 4 and in inoperative positions (as shown in FIG. 1) wherein the press plate member 14 is spaced from the concrete surface.

Figure 10:
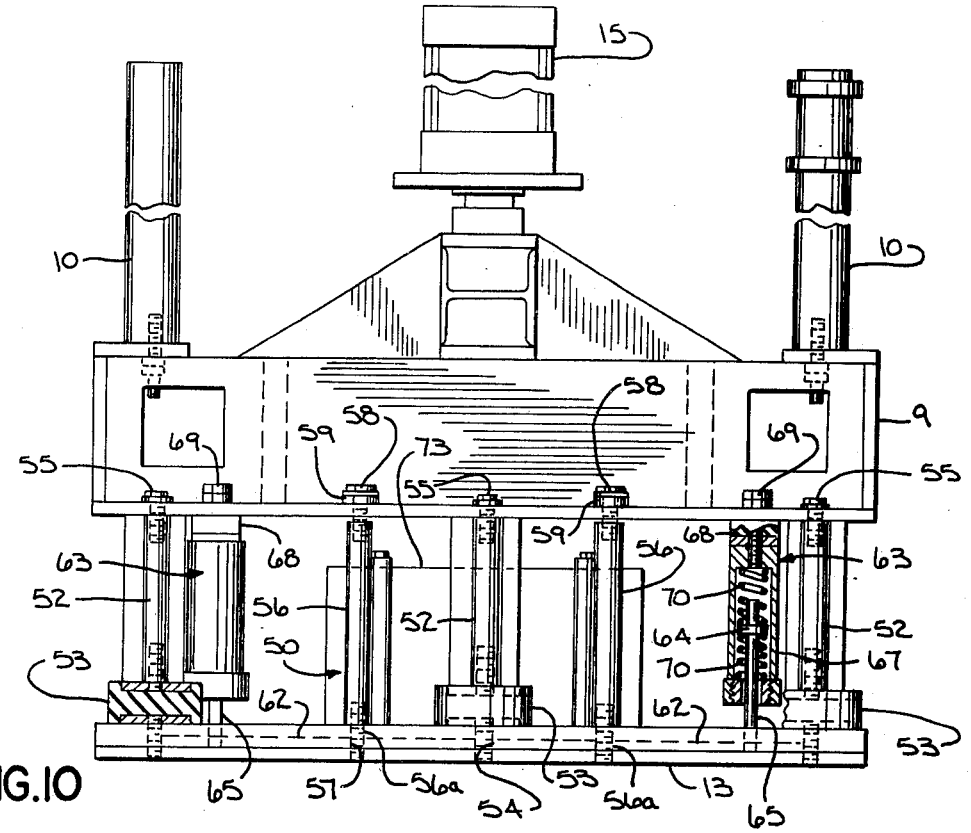
FIG. 10 is an enlarged front view in elevation of a concrete mold press for the machine of FIG. 1.
Figure 12:
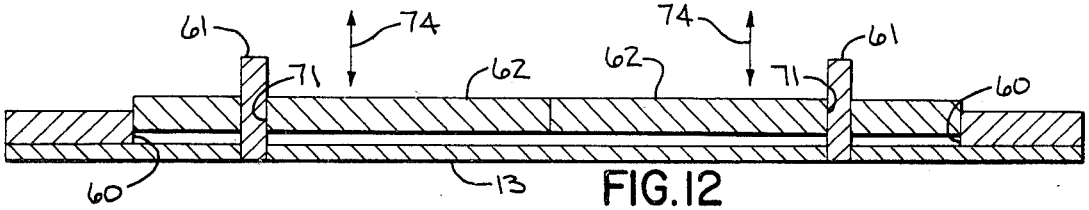
FIG. 12 is a side view in cross section taken along the plane of the line 12—12 in FIG. 13.
Figure 14:
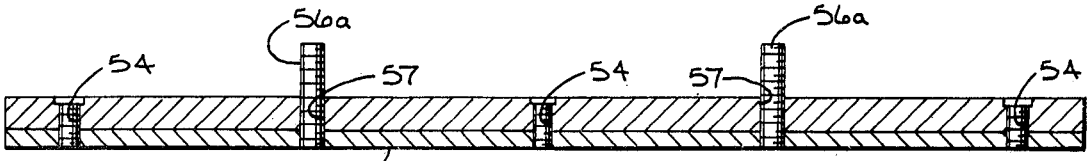
FIG. 14 is a side view in cross section taken through the plane of the line 14—14 in FIG. 13.
Figure 13:
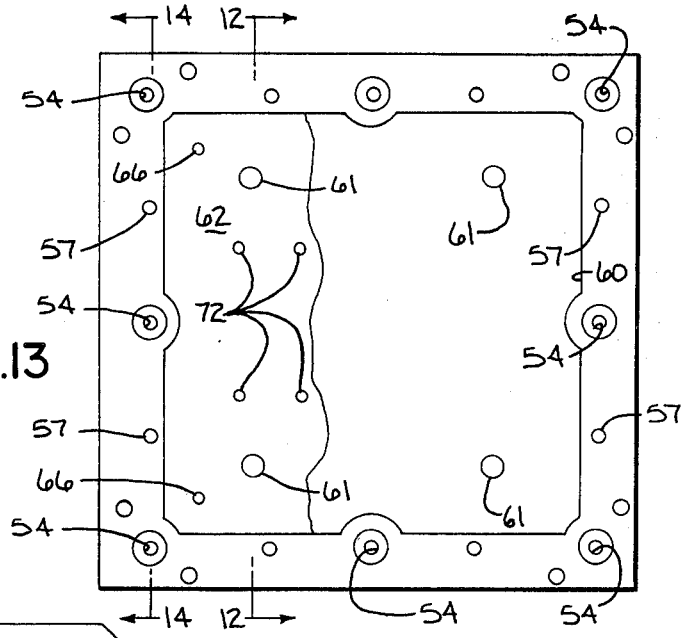
FIG. 13 is a top plan view with parts broken away of one of the reciprocating tamping plates and the compacting plate for the concrete mold press shown in FIG. 10.

The compacting plate member 13 is mounted in a depending manner on carriage 9 by means of a plurality of spacer rods 52. Each spacer rod 52 includes a threaded lower end connected to a rubber dampener 53 and is engaged within a threaded hole 54 in plate 13, as seen best in FIGS. 13 and 14. The rubber dampers 53 isolate the press head vibrations from carriage 9. The top end of each spacer rod 52 is secured to carriage 9 by means of a bolt 55. In addition to spacer rods 52, compacting plate 13 is also connected to carriage 9 by means of a plurality of secondary rod members 56. Each rod 56 has a threaded lower end 56*a* adapted to be received within a threaded opening 57 in the edge margin of plate 13. As seen in FIG. 13, a threaded opening 57 is disposed between each threaded hole 54 on the front and back sides of plate 13 and thus there are eight spacer rods 52 and four secondary rods 56 which mount the compacting plate 13. The upper end of each rod 56 is spaced from the undersurface of carriage 9, as seen in FIG. 10, and is mounted thereto by means of bolts 58. The bolts 58 have rubber washers 59 positioned between the heads of each bolt 58 and the carriage 9 to isolate press head vibrations from carriage 9. The secondary rods 56 generally do not affect the tamping operation and are provided as a secondary backup feature. As seen best in FIGS. 12 and 13, compacting plate member 13 also includes a rectangular shaped recess 60 formed in its central portion, and four guide pins 61 which project vertically upwardly from plate 13. The guide pins 61 are utilized to guide a tamping plate for tamper 50 as will hereinafter be described.

Figure 11:
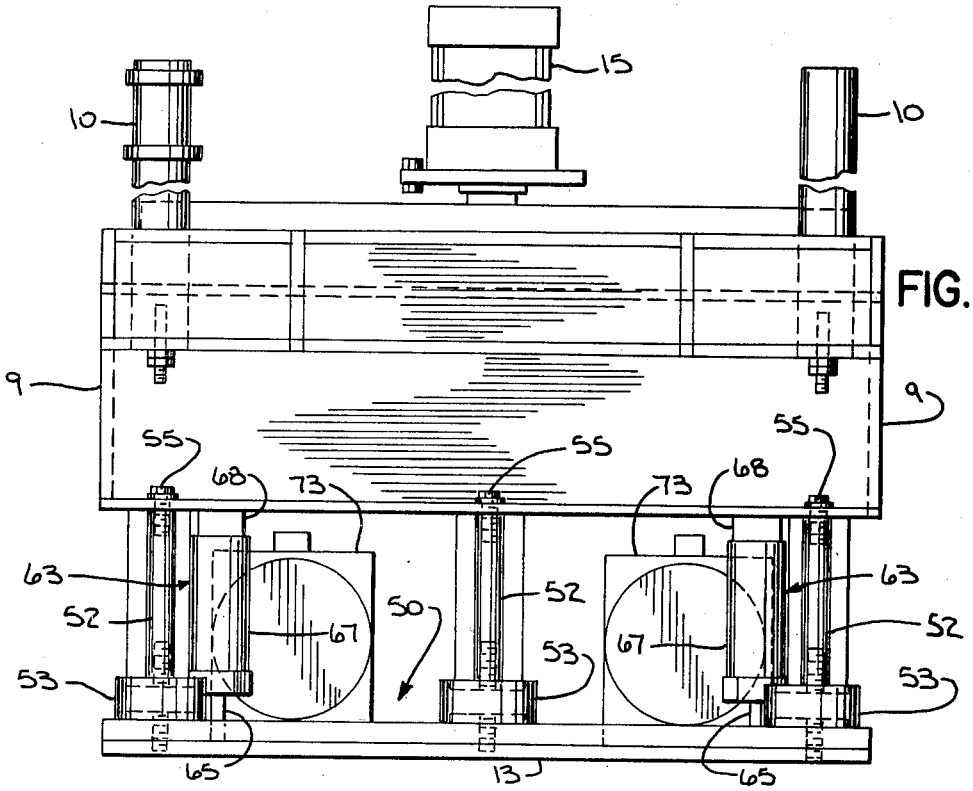
FIG. 11 is a side view in elevation of the concrete mold press shown in FIG. 10.

The tamper 50 includes a pair of tamping plate members 62 located side-by-side within recess 60 and reciprocally mounted on carriage 9 between the undersurface of carriage 9 and compacting plate 13 to vertically oscillate in response to press head vibrations to repeatedly strike the compacting plate 13. The repeated striking of plate 13 provides a tamping force which is transmitted through the compacting plate 13 and press plate 14 to the concrete when the press head 12 is in its operative position. The reciprocal mounting connection of tamping plates 62 is provided by a mounting means which permits relative vertical oscillatory movement between the tamping plates 62 and compacting plate 13. The mounting means includes a plurality of spring assemblies 63 connected between the carriage 9 and the tamping plates 62 each of which have a spring loaded piston 64 and connecting rod 65. Each rod 65 has a threaded end which is engaged in a threaded opening 66 in one of the tamping plates 62 and the shank of each rod 65 projects vertically upwardly therefrom as seen in FIGS. 10 and 11. Piston 64 is connected to the other end of each rod 65 and is housed within a hollow cylinder or housing 67 mounted at its closed end to the carriage 9 and extending downwardly therefrom to encircle rod 65 and piston 64. A rubber dampener 68 is located between the closed end of housing 67 and carriage 9 to isolate press head vibrations from carriage 9, and a bolt 69 is firmly attached to the dampener 68 which, in turn, is connected to the housing 67 to mount cylinder 67 to carriage 9. Each piston 64 is slidable within its corresponding cylinder 67 to permit relative movement between cylinder 67 and rod 65. A pair of springs 70 is disposed within each housing 67 which bear against opposite sides of piston 64 to provide vertical oscillatory movement for tamping plates 62.

Figure 15:
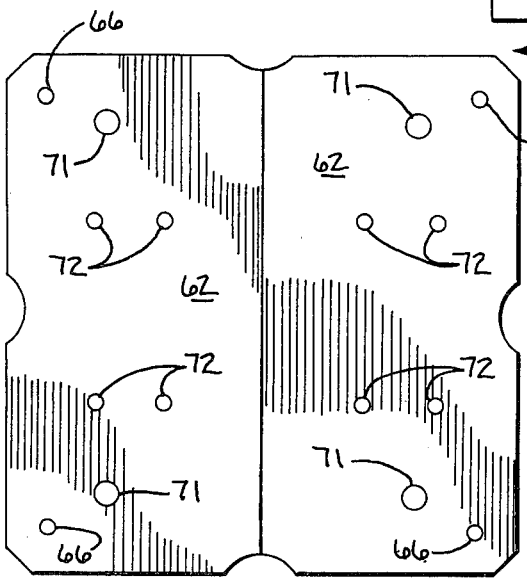
FIG. 15 is an enlarged top plan view of the tamping plates shown in FIGS. 12 and 13.

As seen best in FIGS. 13 and 15 each tamping plate 62 includes two openings 71 which slidably receive two guide pins 61 projecting from contacting plate member 13. Also, each tamping plate 62 includes four mounting holes 72 for mounting a vibrator 73. The vibrator 73 provides the vibratory motion for press head 12 when in its operative position in contact with the concrete in mold 4. Thus, vibrators 73 provide an up and down vibratory motion for press head 12 which results in tamping plate 62 vertically oscillating, as shown by the arrows 74 in FIG. 12.

In operation, when it is desired to form a concrete block having a wet and coarse aggregate face layer and a back layer of a drier and finer consistency, a pallet is fed along a feed tray 75 (FIG. 1) located beneath feed drawer assembly 3 until it is positioned beneath mold 4 and above cylinder 18. A pallet is used having dimensions which correspond to the shape of mold 4. Once located beneath mold 4, cylinder 18 may be actuated to lift the pallet upward to mate with the bottom of mold 4 so that the pallet closes off the bottom of mold 4. When the pallet is in position, feed drawer assembly 2 is activated and as it is driven to the right as seen in FIG. 1 wet and coarse aggregate concrete is fed by gravity into feed drawer 29 from hopper 6. When feed drawer 29 is in its dispensing position over mold 4, cylinders 49 are actuated to move gate 35 and grill member 36 to their open position so that concrete may flow from drawer 29 into mold 4 to form the face layer of the block. The concrete is evenly distributed within the bottom of mold 4 by means of a U-shaped rib 37, the bars 43 of grill member 46, and the vibrations of vibrators 17. The face layer is comprised of a relatively wet and coarse aggregate concrete mix. For example, the face mix may contain $\frac{3}{4}$ inch stone having relatively high water/cement ratio, and if mold 4 is about $2\frac{5}{8}$ inches high the face layer may comprise up to about $\frac{3}{4}$ inches in thickness. After feed drawer 29 deposits the face mix into mold 4, it is returned to its initial mounting position beneath hopper 6, and feed drawer assembly 3 is then actuated to deposit the back layer into mold 4. Thus feed drawer 19 is driven by cylinder 24 from its loading position beneath hopper 8 to its dispensing position above mold 4. As it passes over mold 4 a drier and finer concrete mix is deposited by gravity into the top of mold 4. This drier and finer mix may contain $\frac{1}{4}$ inch stone in a drier mixture than the face mix, i.e. a relatively low water/cement ratio, and may fill the remaining depth of mold 4 to a thickness of about $1\frac{1}{4}$ inches. After the concrete from feed drawer 19 has been deposited within mold 4, cylinder 24 will return feed drawer 19 to its initial loading position. As drawer 19 returns to its loading position the doctor blade 25 provides a leveling action across the top surface of the concrete in mold 4 and also compensates for density differences in the unhardened concrete by intermittently raising blade 25 upon the actuation of control switches 27 and 28 as previously described herein.

Once feed drawer 19 has returned to its initial position, the mold press may be actuated by cylinder 15 to lower the press plate 14 against the top surface of the concrete in mold 4. During this operation the entire press head 12 is being vibrated by vibrators 73 which in turn cause tamping plates 62 to provide a tamping force against the concrete in mold 4, as previously described. This tamping force together with the pressure applied by cylinder 15 compacts the concrete within mold 4 to a solid mass and provides the concrete block with uniform density and strength. Cylinders 15 and 18 thereafter work together to lower the pallet and strip the molded block from the mold. Thereafter, the press head 12 and attached press plate 14 is raised to its upper position. When the pallet is level with feed tray 75, the next pallet will be fed into position beneath mold 4 and push the first pallet supporting the newly molded block to the left as seen in FIG. 1 and onto a conveyor means (not shown) for further processing. For example, the face layer might be sprayed with water to wash away the cement and expose the stone for decorative purposes.

A concrete molding machine has been shown and described which provides a means for controlling the distribution of concrete flowing from a feed drawer into a mold, and a means for compacting the concrete in the mold.

Various modes of carrying out the invention are contemplated as being within the scope of the following claims particularly pointing out and distinctly claiming the subject matter which is regarded as the invention.

I claim:

1. A concrete mold press for a concrete molding machine, comprising:

a main frame;

a carriage slidably mounted for vertical movement on said frame above a mold for containing cement-mix;

a cement mix engaging compacting plate member carried by said carriage and having a press plate member receivable in said mold for engaging the surface of said cement-mix in the mold, said press plate member being moveable between an operating position in pressing contact with the cement mix surface and a position spaced from said cement mix surface, means for moving said carriage toward and away from said mold to move said engaging member between said positions and to compress the cement mix in the mold;

vibration-producing means operatively associated with said compacting and press plate members;

tamping means responsive to the vibrations of said compacting and press plates and disposed so as to strike said compacting plate member and impart an intermittant tamping action to said member in addition to said vibrations and to the compressing action of said member when said member is in contact with the cement mix.

2. The concrete mold press of claim 1, further including a compacting plate member carried by said carriage upon which said tamping means repeatedly strikes, and said concrete-engaging member is connected to and disposed beneath said compacting plate member and spaced therefrom.

3. The concrete mold press of claim 2, wherein said compacting plate member includes a recess formed in its top surface and said tamping means includes a tamping plate member receivable within said recess.

4. The concrete mold press of claim 2, wherein said compacting plate member is disposed beneath said carriage and spaced therefrom, and is mounted in a depending manner on said carriage by a plurality of spacer rods.

5. The concrete mold press of claim 4, wherein each of said spacer rods includes a vibration-dampening means disposed between one end of said rod and said compacting plate member to isolate vibrations from said carriage.

6. The concrete mold press of claim 3, wherein said vibration-producing means is mounted on said tamping plate member.

7. A concrete mold press for a concrete molding machine, comprising:

a main frame;

a carriage slidably mounted for vertical movement on said frame above a mold for containing cement mix;

a compacting plate member mounted in a depending manner on said carriage and disposed beneath said carriage and spaced therefrom;

a press plate member carried by said compacting plate member and receivable in said mold to engage the surface of cement mix in the mold, said press plate member being movable between operative postion in pressing contact with said cement mix surface for applying a compressing action thereon and an inoperative position spaced from said cement mix surface;

means for moving said carriage toward and away from said mold to move said press plate member between said positions;

vibration-producing means operatively associated with said compacting plate member for vibrating said compacting plate member; and tamping means responsive to the vibrations of said press plate and disposed so as to strike said press plate member and thereby impart an intermittant tamping action upon said press plate member in addition to the compressing action and said vibrations so that said tamping action is transferred through said press plate member to the cement mix surface to compact the cement mix in the mold when said press plate member is in its operative position, said tamping means including a tamping plate member reciprocally mounted for vertical oscillatory movement on said carriage and disposed between said carriage and said compacting plate member;

and mounting means for mounting said tamping plate member to said carriage, said mounting means permitting relative vertical oscillatory movement between said tamping plate member and said compacting plate member to enable said tamping plate member to provide a tamping action thereagainst.

8. The concrete mold press of claim 7, wherein said compacting plate member includes a recess formed in its top surface, and said tamping plate member is receivable within said recess.

9. The concrete mold press of claim 7, wherein said tamping means includes a pair of reciprocally mounted tamping plate members located side-by-side so that each may repeatedly strike said compacting plate member to provide a tamping force thereagainst.

10. The concrete mold press of claim 9, further including a pair of vibration-producing means, one mounted on each of said tamping plate members.

11. The concrete mold press of claim 7, wherein said tamping plate member includes at least one opening formed therethrough for receiving a guide pin projecting upwardly from said compacting plate member which guide said tamping plate member to insure vertical oscillatory movement between the tamping plate and compacting plate members.

12. The concrete mold press of claim 7, wherein said compacting plate member is mounted to said carriage by a plurality of spacer rods.

13. The concrete mold press of claim 12, further including a vibration-dampening means disposed between one end of each of said rods and said compacting plate member for isolating vibrations from said carriage.

14. The concrete mold press of claim 7, wherein said mounting means includes at least one spring assembly which includes a rod connected at one end to said tamping plate member and projecting vertically upwardly therefrom, a piston connected to the other end of said rod, a hollow housing mounted at one end on said carriage and extending downwardly therefrom to encircle said rod and piston, said piston being slidable within said housing to permit relative movement between said housing and said rod, and a pair of springs disposed within said housing which bear against opposite sides of said piston to provide vertical oscillatory movement for said tamping plate.

15. The concrete mold press of claim 14, further including vibration-dampening means disposed between said housing and said carriage for isolating vibrations from said carriage.

16. A press for a concrete mold, comprising means for selectively engaging and compacting cement mix withins said mold and including a press member selectively movable between a first cement mix engaging position wherein said member has a compressing action and a second position spaced from the cement mix and a vibrator operatively connected to provide a vibratory motion to said press member when in said first position and tamping means disposed against said press member and operative in response to said vibratory motion to apply an intermittant tamping action to said press member in addition to said compressing action and said vibrations to compact said cement within said mold.

* * * * *

UNITED STATES PATENT AND TRADEMARK OFFICE

CERTIFICATE OF CORRECTION

PATENT NO. : 4,445,839

DATED : May 1, 1984

INVENTOR(S) : JULIUS CRANE

It is certified that error appears in the above-identified patent and that said Letters Patent are hereby corrected as shown below:

| | |
|---|---|
| Abstract, Line 2 | after "operatively" insert ---associated with a vibrating press head which is vertically--- |
| Claim 7: Col. 10, Line 22<br>Ex's. Amend. Dated 11-16-83<br>Line 14 | delete "postion" and substitute therefor ---position--- |

Signed and Sealed this

*Twenty-sixth* Day of *March 1985*

[SEAL]

*Attest:*

DONALD J. QUIGG

*Attesting Officer* *Acting Commissioner of Patents and Trademarks*